US005384967A

United States Patent [19]

Helmuth

[11] Patent Number: 5,384,967

[45] Date of Patent: Jan. 31, 1995

[54] COLLAPSIBLE RAFTER SQUARE

[76] Inventor: William E. Helmuth, 6215 Kulbury Huber Rd., Plain City, Ohio 43068

[21] Appl. No.: 79,463

[22] Filed: Jun. 18, 1993

[51] Int. Cl.[6] ..... B43L 7/10

[52] U.S. Cl. ..... 33/456; 33/416; 33/461; 33/463

[58] Field of Search ..... 33/415, 416, 417, 452, 33/456, 459, 460, 461, 462, 463, 464, 473, 453

[56] References Cited

U.S. PATENT DOCUMENTS

| | | | |
|---|---|---|---|
| 228,027 | 5/1880 | Bissell | 33/456 |
| 368,434 | 8/1887 | Tiller | 33/459 |
| 622,569 | 4/1899 | Van Namee | 33/462 |
| 738,224 | 9/1903 | Morse | 33/463 |
| 806,518 | 12/1905 | Breck | 33/473 |
| 912,605 | 2/1909 | Osmonson | 33/456 |
| 1,040,239 | 10/1912 | Rarey | 33/456 |
| 1,473,860 | 11/1923 | Mullarkey | 33/456 |
| 1,644,624 | 10/1927 | Anderson | 33/416 |
| 2,080,792 | 5/1937 | Simmons | 33/453 |
| 2,131,279 | 9/1938 | Greve | 33/456 |

FOREIGN PATENT DOCUMENTS

| | | | |
|---|---|---|---|
| 0074401 | 6/1980 | Japan | 33/456 |

*Primary Examiner*—Thomas B. Will
*Attorney, Agent, or Firm*—Mueller and Smith

[57] ABSTRACT

A square is disclosed which is especially adapted for the marking of angular dimensions on, or the transfer of angular dimensions from, rafters or other building materials and the like in that only one adjustment is needed to vary the angle being marked or measured. The disclosed square has a first elongate arm, a second elongate arm, and an elongate base having a distal and a proximal end, and a first elongate slot extending longitudinally intermediate its distal and proximal ends. The first elongate arm has a proximal end and a distal end which is pivotally attached to the proximal end of the base. The second has a proximal end, a distal end which is pivotally attached to the proximal end of the first elongate arm, and a second elongate slot extending intermediate its distal and proximal ends for intersection with the first slot. The second elongate arm is slideably moveable along the first slot for its positioning at a select angle with respect to the first elongate arm, and is slideably moveable along the second slot for positioning the first elongate arm at a select angle with respect to the base. An assembly is provided to maintain the second elongate arm at a select position along the first and the second slot.

8 Claims, 4 Drawing Sheets

COLLAPSIBLE RAFTER SQUARE

BACKGROUND OF THE INVENTION

The present invention relates broadly to a measuring square and more particularly to a collapsible rafter square adapted for the facile marking of angular dimensions on, or the transfer of angular dimensions from, rafters or other building materials and the like.

Spurred largely by developments in the science of building materials, the construction trades have undergone somewhat of a renaissance. Indeed, advanced building materials, often composites, laminates or the like, afford a rich opportunity for the design and fabrication of structures which heretofore could only have been imagined. For example, the production of laminated beams has resulted in the availability of longer, wider, and stronger load bearing members for use in spans as floor joists, roof rafters, and the like. Thus, the architect or civil engineer now need not be limited by the confines of conventional building materials.

However, with the advent of advanced building materials and the design opportunities afforded thereby has come the concomitant dilemma of the framer and other tradesmen who must make the dreams of the designer a reality. Unfortunately, advances in construction tools have not been as forthcoming as those associated with the materials of construction. In this regard, construction tools and techniques which were suited to the materials of the day now are inefficient and cumbersome.

In particular, framers are now presented with the prospect of constructing roofs of varying pitches or having spans longer than those once common, often with laminated rafters wider than what was once considered standard. In marking the plumb, level, and seat cuts for common or hip and valley rafters, framers heretofore typically have utilized a common builder or carpenter square. By positioning his or her thumbs along the legs of the square to correspond to the slope or pitch, i.e., rise over run, of the roof to be framed, the framer then could abut the square against the rafter and mark it for cutting. However, such a method, in addition to being cumbersome, was prone to error as the square had a tendency to slip from its intended position when the framer removed one hand therefrom to mark the rafter. This error would often be multiplicative in that one rafter was marked and then used as a template to mark the other rafters. In winter, the square was especially prone to slip on the frost layer which may coat the rafters. Moreover, the width of the rafter which could be marked by the foregoing method was limited by the length of the carpenter square.

In view of the foregoing, it may be seen that there has existed and remains a need for improvements in the marking of angular dimensions onto building materials such as rafters and the like. Such improvements would be well-received by the construction industries, especially framers, roofers, and siders who are now faced with the problem of building increasingly complex structures with unconventional materials.

BROAD STATEMENT OF THE INVENTION

The present invention is directed to an improved measuring square especially adapted for the marking of angular dimensions on, or the transfer of angular dimensions from, rafters or other building materials and the like. In providing a pair of pivotally-connected, elongate arms, one of which is pivotally attached at one end to a base, and an assembly for maintaining the elongate arms at select angular orientations, the present invention facilitates the taking or marking of angular measurements in that only one adjustment need be made to vary the angle being marked or measured. In addition, the inventive square may be provided to be fully collapsible for storage and may be provided with a set of indicia marks calibrated to maintain the elongate arms at a predetermined angle when corresponding indicia marks are aligned, and scaled to correspond to select rafter pitches normalized to a preselected rafter run.

It is, therefore, an object of the present invention to provide a measuring square having a first elongate arm, a second elongate arm, and an elongate base having a distal and a proximal end, and a first elongate slot extending longitudinally intermediate the distal end and the proximal end. The first elongate arm has a proximal end and a distal end which is pivotally attached to the proximal end of the base. The second elongate arm has a proximal end, a distal end which is pivotally attached to the proximal end of the first elongate arm, and a second elongate slot extending intermediate its distal and its proximal end for intersection with the first slot. The second elongate arm is slideably moveable along the first slot for positioning at a select angle with respect to the first elongate arm, and is slideably moveable along the second slot for positioning the first elongate arm at a select angle with respect to the base. An assembly is provided to maintain the second elongate arm at a select position along the first slot and the second slot. The second elongate arm and the base may be provided on at least one side thereof with a set of indicia marks calibrated such that the second elongate arm is oriented at a predetermined angle with respect to the first elongate arm when corresponding indicia marks on the second elongate arm and the base are aligned. The indicia marks may be scaled to orient the first elongate arm at select angles with respect to the base when corresponding indicia marks are aligned.

It is also an object of the present invention to provide a collapsible measuring square having a first elongate arm, a second elongate arm, and an elongate base having a distal and a proximal end, and a first elongate slot extending longitudinally intermediate the distal end and the proximal end. The first elongate arm has a proximal end and a distal end which is pivotally attached to the proximal end of the base. The second elongate arm has a proximal end, a distal end which is pivotally attached to the proximal end of the first elongate arm, and a second elongate slot extending intermediate its distal and its proximal end for intersection with the first slot. The second elongate arm is slideably moveable along the first slot for positioning at a select angle with respect to the first elongate arm, and is slideably moveable along the second slot for positioning the first elongate arm at a select angle with respect to the base. The first slot and the second slot are provided to have lengthwise extents allowing the first elongate arm and the second elongate arm to be disposed substantially parallel to the elongate base. An assembly is provided to maintain the second elongate arm at a select position along the first and the second slot.

It is yet another object of the present invention to provide a rafter square having a first elongate arm, a second elongate arm, and an elongate base having a distal and a proximal end, and a first elongate slot extending intermediate the distal end and the proximal end. The first elongate arm has a proximal end and a distal end which is pivotally attached to the proximal end of the base. The second elongate arm has a proximal end, a distal end which is pivotally attached to the proximal end of the first elongate arm, and a second elongate slot extending intermediate its distal and its proximal end for intersection with the first slot. The second elongate arm is slideably moveable along the first slot for positioning at a select angle with respect to the first elongate arm, and is slideably moveable along the second slot for positioning the first elongate arm at a select angle with respect to the base. An assembly is provided to maintain the second elongate arm at a select position along the first and the second slot. The second elongate arm and the base are provided on at least one side thereof with a set of indicia marks calibrated such that the second elongate arm is oriented at a predetermined angle with respect to the first elongate arm when corresponding indicia marks on the second elongate arm and the base are aligned, and scaled to orient the first elongate arm at select angles with respect to the base when corresponding indicia marks are aligned. The angles between the first elongate arm and the base may be selected to correspond to select rafter pitches normalized to a preselected rafter run.

An advantage of the present invention includes facilitating the marking of angular dimensions on, or the transfer of angular dimensions from, rafters or other building materials and the like with only a single adjustment and alignment needed to vary the angle or pitch being marked or measured. Other advantages of the present invention include facilitating the marking of an angular measurement across the entire width of a relatively wide rafter, beam or the like, and the capability to be made fully collapsible for storage and reversible. These and other advantages of the present invention will be readily apparent to those skilled in the art based upon the disclosure contained herein.

The figures will be described further in connection with the following Detailed Description of the Invention.

DETAILED DESCRIPTION OF THE INVENTION

In the discourse to follow, the precepts of the present invention will be described in connection with its utilization as a rafter square adapted for the marking of plumb and level lines onto rafters or other building materials such as trim, siding or the like. However, it will be appreciated that the present invention has features making it suitable for use as a measuring square in the transferring, marking, or measuring of angular dimensions. As used herein, measuring squares encompass carpenter's or builder's squares, marking squares, drafting squares, and like tools for measuring, transferring, or marking angular dimensions.

Figure 1:
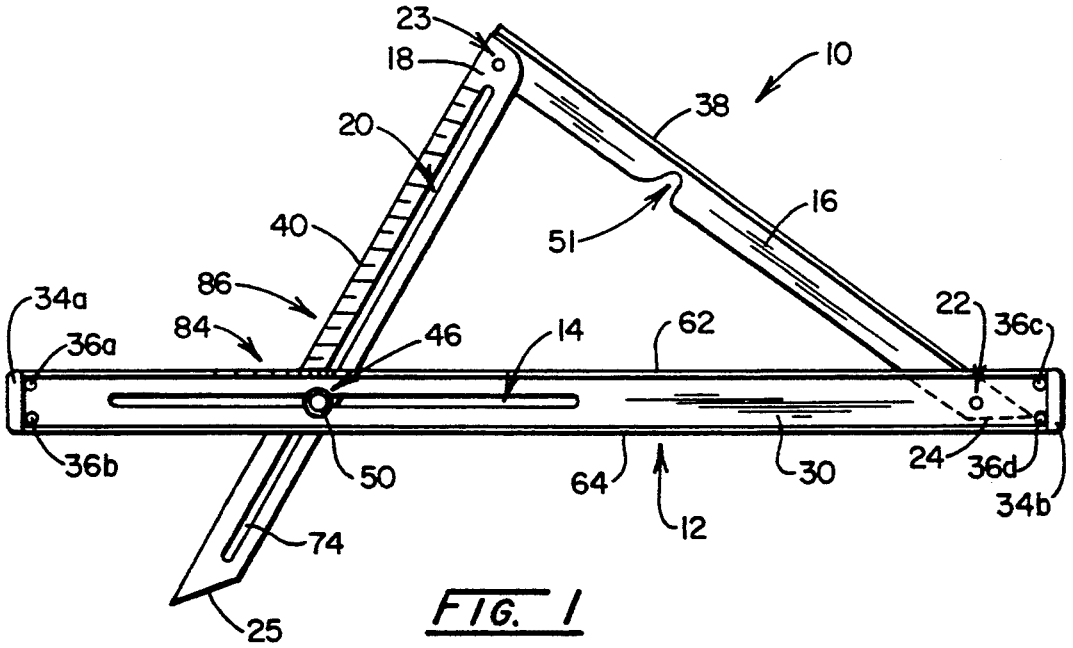
FIG. 1 is a side elevational view of a rafter square in accordance with the precepts of the present invention showing the elongate arms thereof in an extended orientation for marking or measuring.

Looking to FIG. 1, a rafter square according to the present invention for marking plumb and level lines onto rafters and the like for their cuffing in accordance therewith is shown generally at 10. Rafter square 10 may be seen to comprise a generally planar, elongate base, shown generally at 12, having a slot, represented at 14, extending longitudinally through a portion thereof. Base 10 is pivotally connected at one end to a generally planar, first elongate arm, 16, which, in turn, is pivotally connected at its other end to a second generally planar, elongate arm, 18, having a second elongate slot, represented at 20, for intersection with first elongate slot 14. For pivotally connecting base 12 to first elongate arm 16, and for pivotally-connecting first elongate arm 16 to second elongate arm 18, pins may be provided as are shown at 22 and 23, respectively. It is preferred that ends 24 and 25 of, respectively, arms 16 and 18, are angled at 45°.

Figure 3:
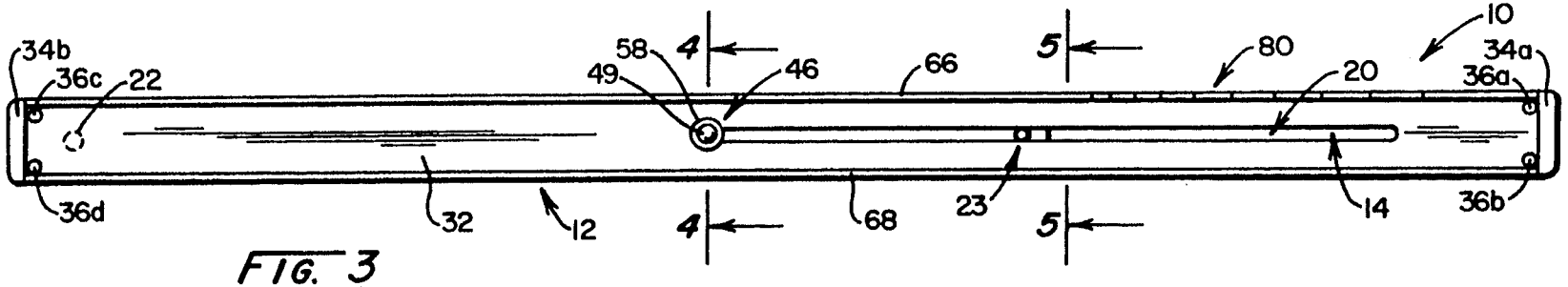
FIG. 3 is a elevational view of the rafter square of FIG. 1 showing the elongate arms thereof in a collapsed orientation for storage.
Figure 2:
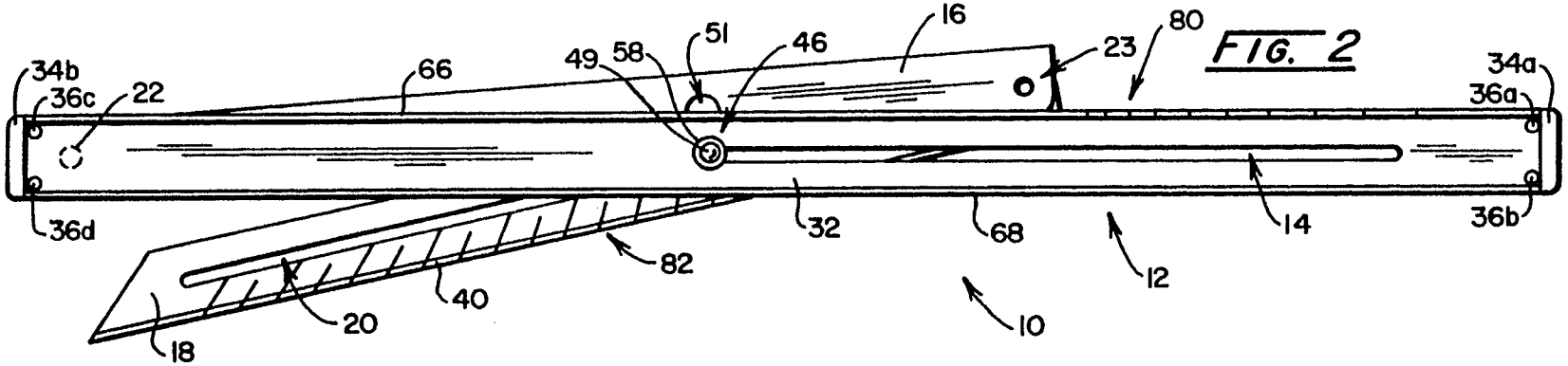
FIG. 2 is an elevational view of the rafter square of FIG. 1 showing the elongate arms thereof in a partially collapsed orientation.

By virtue of the pivotal attachments at 22 and 23, second elongate arm 18 is provided to be slideably movable along first slot 14 for its positioning at a select angle with respect to first elongate arm 16, and is provided to be slideably moveable along second elongate slot 20 for positioning first elongate arm 16 at a select angle with respect to elongate base 12. Looking additionally to FIGS. 2 and 3, it may be seen that rafter square 10 may be configured to be fully collapsible. Accordingly, slots 14 and 20 may be sized as having lengthwise extents allowing elongate arms 16 and 18 to be disposed substantially parallel to base 12 with slots 14 and 20 in registry. To dispose arms 16 and 18 parallel to base 12, end 25 of arm 18 may be slideably moved along slot 14 towards pivot pin 22 (FIG. 2). Arm 18 then may be slideably moved along slot 20 towards pivot pin 23 to rotate arm 16 towards base 12 (FIG. 3). Preferably, arms 16 and 18 are sized as having lengthwise extents which do not extend beyond the lengthwise extent of base 12 when disposed substantially parallel thereto. So configured, rafter square 10 advantageously folds compactly for portability or storage.

Figure 6:
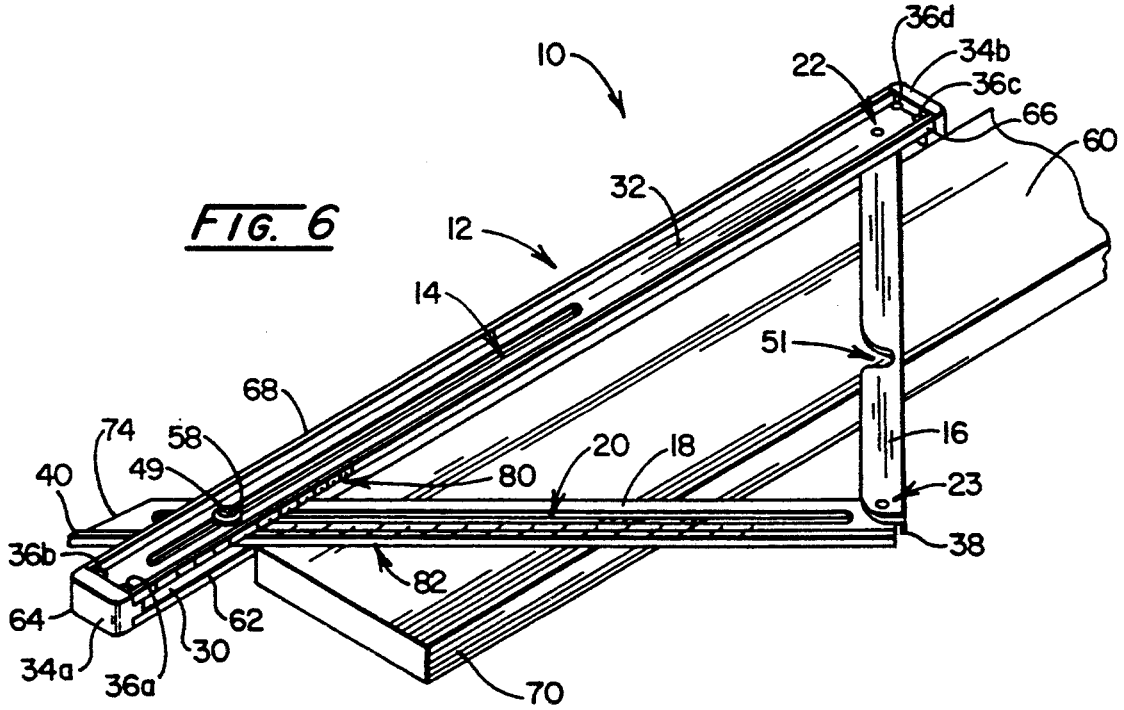
FIG. 6 is a perspective view of the rafter square of FIG. 1 abuttingly engaging a piece of building material for its marking.
Figure 5:
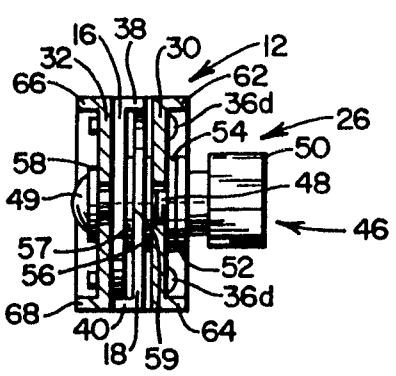
FIG. 5 is a cross-sectional view of the rafter square of FIG. 1 taken through the line 5—5 of FIG. 3.

Returning to FIG. 1, and looking momentarily to FIG. 6, it may be seen that elongate base 12 may be provided as a pair of elongate members, 30 and 32, each having a slot 14 and laterally spaced apart to receive arm 18 and the mounting of arm 16 therebetween. Providing base 12 as a spaced-apart pair of elongate members imparts a symmetry to rafter square 10 making either side thereof usable. Spacers, 34*a* and 34*b*, may be provided at each end of base 12 to define the spacing between elongate members 30 and 32, and may be secured to elongate members 30 and 32 with fasteners, 36*a–d*, which may be of a rivet type. Also, arms 16 and 18 may be provided with upstanding flanged portions, 38 and 40. As may be seen in FIGS. 5 and 6, it is preferred that flanged portions 38 and 40 are configured such that, when arms 16 and 18 are positioned in a collapsed orientation, flange 38 abuttingly engages a corresponding edge of arm 18, and flange 40 abuttingly engages a corresponding edge of arm 16. Flanged portions 38 and 40 serve to level arms 16 and 18 against a workpiece when base 12 is abutted thereagainst, and also function as straightedges facilitating the marking of the workpiece therealong.

Figure 4:
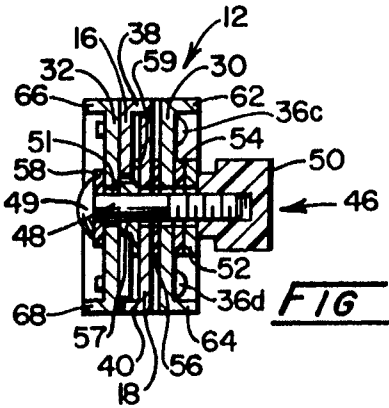
FIG. 4 is a cross-sectional view of the rafter square of FIG. 1 taken through the line 4—4 of FIG. 3 showing the assembly for locking the elongate arms of the square in position.

Returning again to FIG. 1, an adjustable locking assembly is shown generally at 46 for maintaining second elongate arm 18 at a select position along first slot 14 for operation or storage. Returning again also to FIGS. 4 and 5, adjustable assembly 46 may be provided as an elongate, threaded member, 48, extending through first elongate slot 14 and second elongate slot 20. Preferably, threaded member 48, which may be a machine screw, carriage bolt, or the like, has a head portion, 49, for retaining base 12. A knob, 50, or another nut or the like, may be threadably engaged with threaded member 48 and provided to be movable therealong to effect a compressive engagement between second elongate arm 18 and base 12 delimiting the movement of second elongate arm 18 along first slot 14 and second slot 20. It is preferred that arm 16 is notched, as is represented at 51, for receiving threaded member 48 when arms 16 and 18 are positioned in a collapsed orientation (FIG. 2).

Alternatively, adjustable assembly 46 might be provided as a lever, clamp, or other means to effect a compressive engagement between second elongate arm 18 and base 12. Moreover, as an alternative to effecting a compressive engagement between second elongate arm 18 and base 12, arms 16 and 18 might be provided to be ratchetable about pivot pins 22 and 23. It will be appreciated that such alternative means and others that may be envisioned by those of ordinary skill in the art may be employed in conjunction with or independent of slots 14 and 20. Thus, it is within the precepts of the present invention to eliminate slot 14 from base 12, and slot 20 from arm 18, depending upon which means for maintaining arm 18 at a select position along base 12 is chosen by a practitioner of the present invention.

To facilitate a compressive engagement between second elongate arm 18 and base 12 and the movement of second elongate arm 18 along slots 14 and 20, washers may be disposed coaxially with threaded member 48. For example, washer 52 and beating washer 54 may be interposed between knob 50 and base 12 member 30, bearing washer 56 may be interposed between arm 18 and member 30, spacer bushing 57 may be interposed between arm 18 and base 12 member 32, and bearing washer 58 may be interposed between member 32 and head portion 49 of threaded member 48. Beating washers (not shown) also may be disposed coaxially with pivot pin 23 for interposition between arms 16 and 18, and coaxially with pivot pin 22 for interposition between arm 16 and base 12 member 32. In the described embodiment, spacer bushing 57 maintains arm 18 a predetermined distance from member 42 and has a bearing surface, 59, for receiving arm 18 in a locking, abutting engagement with bearing washer 56 when knob 50 is rotatably moved along threaded member 48 into a compressive engagement with member 30. Spacer bushing 57 is received by notch 51 when square 10 is in a collapsed orientation (FIG. 3). Preferably, beating washers 54, 56, and 58, and spacer bushing 57 are formed of a compressible, polymeric material having a relatively low coefficient of friction such as a nylon, a polytetrafluoroethylene, or the like.

Returning to FIG. 1 and looking additionally to FIG. 6, the use of rafter square 10 is illustrated in conjunction with the marking of a roof rafter, 60, which may be, for example, a common, a hip and valley, or a jack rafter. Prior to nailing rafter 60 to the header board of a roof, plumb cuts must be made at the ends thereof. Additionally, if rafter 60 overhangs a wall, a seat cut comprising an orthogonal plumb and level cut must be made at some determinable distance intermediate the plumb cuts. The location of these cuts along the length of rafter 60 depends on the span and pitch of the roof and may be determined trigonometrically or with the aid tables such as those contained in Riechers, *Full Length Roof Framer,* 18th Edition, Box 405, Palo Alto, Calif. (1917), the disclosure of which is expressly incorporated herein by reference.

To facilitate the marking of the plumb and level cuts on rafter 60, base 12 may be provided along at least one edge thereof an upstanding flanged portion, 62, for forming a confronting surface for abutting an edge of rafter 50. Preferably, flanged portions 64, 66, and 68, also are provided to form confronting surfaces on each of the edges of base 12 elongate members 30 and 32. By so configuring base 12, the flexibility of rafter square 10 is enhanced in that any edge on any side of base 12 may be used as a confronting surface. Once elongate arms 16 and 18 are positioned at the desired orientation corresponding to, respectively, level and plumb for a given pitch, ranged portions 38 and 40 may be used as straightedges to mark rafter 60 for plumb, level, or seat cutting. If the width of rafter 60 were to extend beyond the lengthwise extents of arms 16 and 18, marking could still be effected across the entire width of rafter 60 simply by repositioning square 10 to have ranged portion 64 confront edge 70 and continuing marking along portion 74 of arm 18. Thus, it may be appreciated that square 10 is adapted to the marking of rafters and the like wider than the lengthwise extents of arms 16 and 18.

Figure 7:
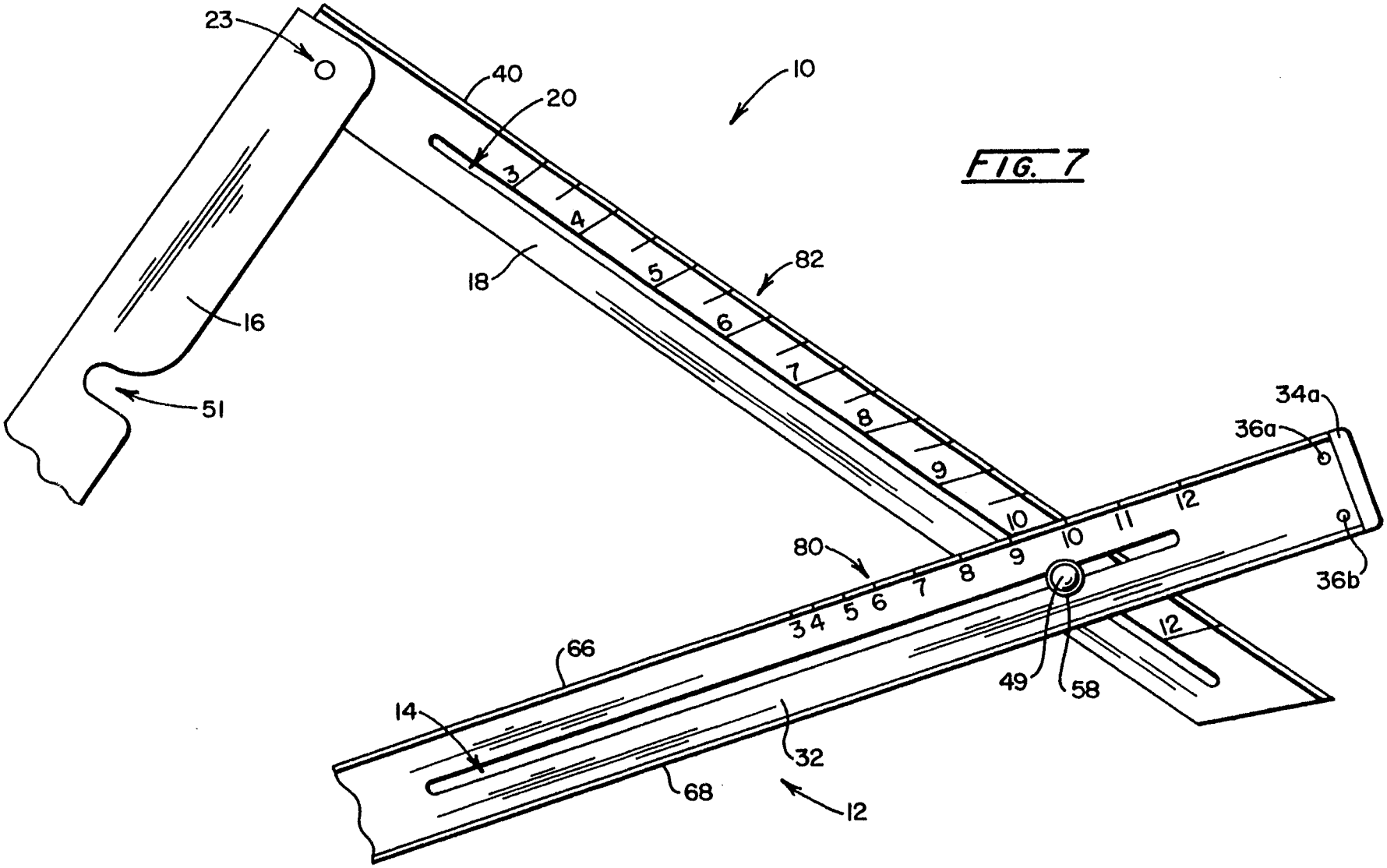
FIG. 7 is a fragmentary enlarged elevational view of the rafter square of FIG. 1 showing the scaled indicia marked on the base and an elongate arm thereof for determining select pitches for common rafters normalized to a preselected rafter run of 12 units.

For positioning elongate arms 16 and 18 to a desired orientation for the marking of plumb or level cuts, indicia sets may be provided on second elongate arm 18 and base 12. Preferably, such indicia sets are provided on each side of arm 18 and base 12 to make rafter square 10 reversible. Looking to FIG. 7, representative indicia sets are shown at 80 and 82 as marked on, respectively, member 32 of base 12 and the corresponding side of arm 18. Indicia sets 80 and 82 are calibrated such that arm 18 is oriented or maintained at a predetermined angle with respect to arm 16 when correspondingly numbered indicia marks on arm 18 and base 12 are aligned by moving arm 18 along slots 14 and 20. For the marking of roof rafters, it is preferred that the predetermined angle maintained between arms 16 and 18 is 90° such that arm 16 will be positioned corresponding to level for a given pitch and arm 18 will be positioned corresponding to plumb for that pitch. Indicia sets 80 and 82 are also scaled to position arm 16 at various select angles with respect to base 12 when correspondingly numbered indicia marks on arm 18 and base 12 are aligned. As only the relative lengths of base 12 and arm 18 are changed to effect the alignment of corresponding indicia, it may be appreciated that the select angles between arm 18 and base 12 correspond to rafter pitches normalized to a given rafter run, e.g., 12 for common rafters and 17 for hip and valley rafters. For example, alignment of the correspondingly numbered indicia marks of indicia sets 80 and 82 would correspond to roof pitches, i.e., rise/run, of 3/12, 4/12, 5/12, 6/12, 7/12, 8/12, 9/12, 10/12, 11/12, and 12/12, thereby making sets 80 and 82 suitable for the marking of plumb and level lines on common rafters. As is shown in FIG. 7, the divisions of the indicia sets may be subdivided to account for half pitches, quarter pitches, or the like.

Figure 8:
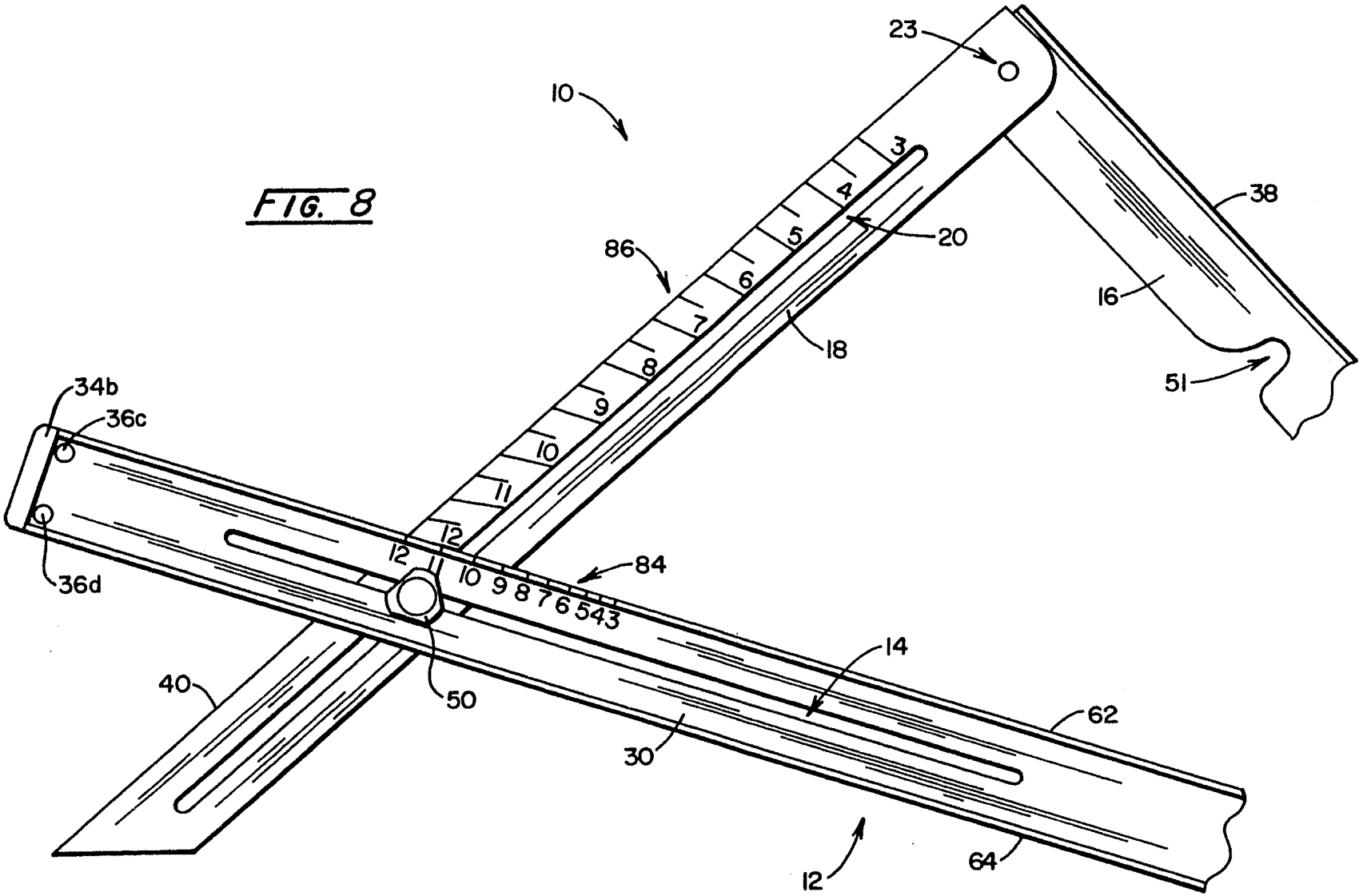
FIG. 8 is a fragmentary enlarged elevational view of the rafter square of FIG. 1 showing the scaled indicia marked on the base and on an elongate arm thereof for determining select pitches for hip and valley rafters normalized to a preselected rafter run of 17 units.

Looking to FIG. 8, representative indicia sets are shown at 84 and 86 as marked on, respectively, member 30 of base 12 and the corresponding side of arm 18. Indicia sets 84 and 86 are scaled to position arm 16 at various select angles with respect to base 12 corresponding to rafter pitches normalized to rafter run of 17 for the marking of hip and valley rafters. Thus, in the embodiment illustrated in FIGS. 7 and 8, rafter square 10 is advantageously provided to be reversible and adapted for the marking of plumb and level lines on rafters of both the common and the hip and valley variety.

Indicia sets calibrated and scaled as described in connection with FIGS. 7 and 8 are preferred as the framer or other user need only make one adjustment to change the position arm 16 relative to that of base 12 for the positioning of arms 16 and 18 at orientations corresponding to plumb and level for a given pitch normalized to a preselected run. Such indicia sets may be calibrated and scaled empirically, for example, by maintaining an angle of 90° between arms 16 and 18 and then positioning arm 16 at select angular positions with respect to base 12 corresponding to select roof pitches for a given rafter run. The position of arm 18 with respect to base 12 for each of the select angular positions may be noted by appropriate markings along arm 18 and base 12. Alternatively, the indicia sets may be calibrated and scaled analytically using, for example, the Pythagorean theorem, since, for a given roof pitch and rafter run, the relative lengths of arms 16 and 18 will be known and the relative length of base 12 therefore may be determined.

Although indicia sets calibrated and scaled as illustrated by sets 80 and 82, and 84 and 86, are preferred if square 10 is to be employed in the marking of rafters, trim or siding boards, and the like, it may be appreciated that such indicia marks may be scaled and numbered to correspond to select angular measurements between arm 16 and base 12. When so numbered, square 10 may be seen to be adapted for use as a measuring square. Indeed, the indicia sets may be numbered to correspond to both angular measurements and roof pitches.

As to the materials of construction for rafter square 10, it is preferred that base 12, and elongate arms 16 and 18 are constructed of a strong, but relatively lightweight material such as an extruded aluminum or the like. Alternatively, a polymeric material such as a polypropylene, or a composite material such as a fiber-reinforced plastic (FRP) may be employed as a material of construction.

It is anticipated that certain changes may be made in the above-described apparatus without departing from the scope of the invention herein involved. For example, a bubble level or a linear scale may be incorporated into the present invention for added utility. Moreover, the present invention may be sized to accommodate the workpiece to be marked. Accordingly, it is intended that all matter contained in the foregoing description or shown in the accompanying drawings shall be interpreted as illustrative and not in a limiting sense.

What is claimed:

1. A measuring square comprising:

an elongate base formed as a pair of laterally spaced-apart, elongate members, each of said elongate members extending between a proximal end and a distal end, and having a first elongate slot extending longitudinally therethrough intermediate said distal end and said proximal end;

a first elongate arm having a proximal end, and a distal end pivotally mounted to said proximal end of said base intermediate said elongate members;

a second elongate arm having a proximal end, a distal end pivotally attached to said proximal end of said first elongate arm, and second elongate arm for intersection with said first slot, said second elongate arm slideably movable along said first slot for its positioning at a select angle with respect to said first elongate arm and slideably moveable along said second slot for positioning said first elongate arm at a select angle with respect to said elongate base; and an assembly for maintaining said second elongate arm at a select position along said first slot and said second slot, said first slot and said second slot each having lengthwise extents allowing said first elongate arm and said second elongate arm to be disposed between said elongate members substantially parallel to said elongate base, and said second elongate arm and said base each bearing on at least one side thereof a set of indicia marks calibrated such that said second elongate arm is oriented at a predetermined angle with respect to said first elongate arm when corresponding said indicia marks on said second elongate arm and said base are aligned, and scaled to orient said first elongate arm at select angles with respect to said base when said corresponding said indicia marks are aligned.

2. The measuring square of claim 1 wherein said predetermined angle between said second elongate arm and said first elongate arm is selected to be about 90°.

3. The measuring square of claim 2 wherein said select angles between said first elongate arm and said base correspond to select rafter pitches normalized to a preselected rafter run.

4. The measuring square of claim 1 wherein said base has along at least one edge thereof an upstanding flanged portion extending longitudinally intermediate said distal end and said proximal end thereof, said flanged portion forming a confronting surface for abutting an edge.

5. The measuring square of claim 1 wherein said assembly for maintaining said second elongate arm at a select position along said first slot and said second slot comprises:

an elongate, threaded member extending through said first slot and said second slot; and a nut configured for threadable engagement with said threaded member and movable therealong to effect a compressive engagement between said base and said second elongate arm delimiting the movement of said second elongate arm along said first slot and said second slot.

6. The measuring square of claim 1 wherein each said elongate members comprising said base has along at least one edge thereof an upstanding flanged portion extending longitudinally intermediate the distal and proximal ends thereof, each said tangled portion forming a confronting surface for abutting an edge.

7. The measuring square of claim 1 wherein said assembly for maintaining said second elongate arm at a select position along said first slot and said second slot comprises:

an elongate, threaded member extending through said first slot and said second slot; and a nut configured for threadable engagement with said threaded member and movable therealong to effect a compressive engagement between said base and said second elongate arm delimiting the movement of said second elongate arm along said first slot and said second slot.

8. The measuring square of claim 7 wherein said first elongate arm is notched for receiving said threaded member therein when said first elongate arm and said second elongate arm are disposed substantially parallel to said elongate base.

* * * * *